US012571339B2

(12) United States Patent
Oho et al.

(10) Patent No.: US 12,571,339 B2
(45) Date of Patent: Mar. 10, 2026

(54) COOLING DEVICE FOR SHIP PROPULSION MACHINE

(71) Applicant: SUZUKI MOTOR CORPORATION, Hamamatsu (JP)

(72) Inventors: Yasumasa Oho, Hamamatsu (JP); Takanori Nihashi, Hamamatsu (JP); Masahiro Kitabatake, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 530 days.

(21) Appl. No.: 18/152,586

(22) Filed: Jan. 10, 2023

(65) Prior Publication Data

US 2023/0220796 A1 Jul. 13, 2023

(30) Foreign Application Priority Data

Jan. 12, 2022 (JP) ..... 2022-003016

(51) Int. Cl.
*F01P 3/20* (2006.01)
*B63H 20/28* (2006.01)

(52) U.S. Cl.
CPC ..... *F01P 3/202* (2013.01); *B63H 20/285* (2013.01)

(58) Field of Classification Search
CPC .... F01P 3/20; F01P 3/202; F01P 3/205; F01P 2050/02; F01P 2050/04; F01P 2050/12; F01P 2003/001; B63H 21/38; B63H 21/383; B63H 20/28; B63H 20/285; B01D 35/147
See application file for complete search history.

(56) References Cited

U.S. PATENT DOCUMENTS 6,764,360 B2 * 7/2004 Tanaka ..... B63H 21/24 440/88 C
10,336,428 B1 7/2019 Novak et al. ..... 440/88
(Continued)

FOREIGN PATENT DOCUMENTS

JP 2020-163872 A 10/2020

OTHER PUBLICATIONS

Office Action mailed on Feb. 4, 2025, issued Japanese Application No. 2022-003016.

(Continued)

*Primary Examiner* — Benjamin P Lee
(74) *Attorney, Agent, or Firm* — Stein IP LLC

(57) ABSTRACT

A cooling device includes a drain passage, a collection passage and a bypass passage each connecting an upstream portion and a downstream portion of the drain passage, a branched portion branched into the collection passage and the bypass passage, and a confluence portion joined the collection passage and the bypass passage. A difference between flowing directions from the upstream portion into the branched portion and from the branched portion into the collection passage is smaller than a difference between flowing directions from the upstream portion into the branched portion and from the branched portion into the bypass passage. A difference between flowing directions from the bypass passage into the confluence portion and from the confluence portion into the downstream portion is smaller than a difference between flowing directions from the collection passage into the confluence portion and from the confluence portion into the downstream portion.

7 Claims, 8 Drawing Sheets

(56) References Cited

U.S. PATENT DOCUMENTS

| | | | | |
|---|---|---|---|---|
| 10,501,160 | B1 | 12/2019 | Cooper, III et al. ... | B63H 20/28 |
| 12,158,091 | B2 * | 12/2024 | Kono ..... | B63H 20/28 |
| 2002/0182949 | A1 * | 12/2002 | Tanaka ..... | B63H 21/383 440/88 M |
| 2020/0309015 | A1 * | 10/2020 | Watanabe ..... | F01P 11/12 |
| 2021/0380213 | A1 * | 12/2021 | Watanabe ..... | B01D 35/1435 |
| 2023/0219674 | A1 * | 7/2023 | Tanaka ..... | B63H 20/285 440/88 M |
| 2024/0009602 | A1 * | 1/2024 | Araki ..... | B01D 29/56 |

OTHER PUBLICATIONS

Micro Plastic Collecting Device, YouTube[online][video], Suzuki Marine UK, Oct. 1, 2020, [search on Jan. 29, 2025], https://www.youtube.com/watch?v=Oge7DnT8m90.

Extended European Search Report dated Jun. 7, 2023, issued to European Application No. 23150859.9.

* cited by examiner

COOLING DEVICE FOR SHIP PROPULSION MACHINE

CROSS-REFERENCE TO RELATED APPLICATIONS

The disclosure of Japanese Patent Application No. 2022-003016 filed on Jan. 12, 2022, including specification, drawings and claims is incorporated herein by reference in its entirety.

TECHNICAL FIELD

The present disclosure relates to a cooling device for a ship propulsion machine having a function of collecting fine objects diffusing in water such as sea water and lake water.

BACKGROUND ART

In recent years, pollution of sea, lake, river, and the like caused by diffusion of fine waste such as microplastics in water such as sea water, lake water, and river water becomes a problem. It is known that sea, lake, river, and the like are polluted by the dregs of feed used for aquaculture diffusing in water such as sea water, lake water, river water, and the like. In order to reduce such pollution, fine waste such as microplastics, dregs of feed, and the like (hereinafter referred to as "fine objects") is desired to be collected and recovered.

Patent Literature 1 below describes an outboard motor equipped with a cooling device having a function of collecting fine objects. The cooling device takes water such as sea water or lake water into the outboard motor using a pump, and supplies the taken water as cooling water to a water jacket provided in an engine of the outboard motor. The cooling water supplied to the water jacket flows through the water jacket, thereby cooling the engine. After flowing through the water jacket, the cooling water flows through a drain pipe, passes through a filtering device provided in a middle of the drain pipe, and is then discharged to the outside of the outboard motor. As the cooling water passes through the filtering device, fine objects in the cooling water are captured by the filtering device and removed from the cooling water. In this way, according to the cooling device, sea water, lake water, or the like can be taken into the outboard motor, and the fine objects contained in the taken sea water, lake water, or the like can be collected by the filtering device.

In the cooling device described in Patent Literature 1, the drain pipe provided with the filtering device is connected to a bypass passage for flowing the cooling water bypassing the filtering device when the filtering device is clogged. In the cooling device, a relief valve is provided at a connecting portion between an upstream end of the bypass passage and the drain pipe. The relief valve closes when the filtering device is not clogged and guides the cooling water flowing through the drain pipe to the filtering device, and opens when the filtering device is clogged and then guides the cooling water flowing through the drain pipe to the bypass passage, bypassing the filtering device.

Patent Literature 1: JP2020-163872A

SUMMARY

In order to solve the above problem, there is provided a cooling device for a ship propulsion machine, the cooling device being provided in a ship propulsion machine, taking water of an outside of the ship propulsion machine into the ship propulsion machine, cooling a power source of the ship propulsion machine by flowing the taken water around or inside the power source as cooling water, and discharging the cooling water after flowing around or inside the power source to the outside of the ship propulsion machine, the cooling device including: a drain passage configured to discharge the cooling water after flowing around or inside the power source to the outside of the ship propulsion machine; a collection passage provided between an upstream portion and a downstream portion of the drain passage and connecting the upstream portion and the downstream portion of the drain passage; a collector provided in a middle of the collection passage and configured to collect fine objects contained in the cooling water flowing through the collection passage from the upstream portion of the drain passage toward the downstream portion of the drain passage; a bypass passage provided in parallel with the collection passage between the upstream portion and the downstream portion of the drain passage and connecting the upstream portion and the downstream portion of the drain passage; a branched portion where the upstream portion of the drain passage branches into the collection passage and the bypass passage; and a confluence portion where the collection passage and the bypass passage join the downstream portion of the drain passage, in which the upstream portion of the drain passage, the collection passage, and the bypass passage are arranged such that a difference between a flowing direction of the cooling water flowing from the upstream portion of the drain passage into the branched portion and a flowing direction of the cooling water flowing from the branched portion into the collection passage is smaller than a difference between the flowing direction of the cooling water flowing from the upstream portion of the drain passage into the branched portion and a flowing direction of the cooling water flowing from the branched portion into the bypass passage, and the downstream portion of the drain passage, the collection passage, and the bypass passage are arranged such that a difference between a flowing direction of the cooling water flowing from the bypass passage into the confluence portion and a flowing direction of the cooling water flowing from the confluence portion into the downstream portion of the drain passage is smaller than a difference between a flowing direction of the cooling water flowing from the collection passage into the confluence portion and a flowing direction of the cooling water flowing from the confluence portion into the downstream portion of the drain passage.

DESCRIPTION OF EMBODIMENTS

Figure 8A:
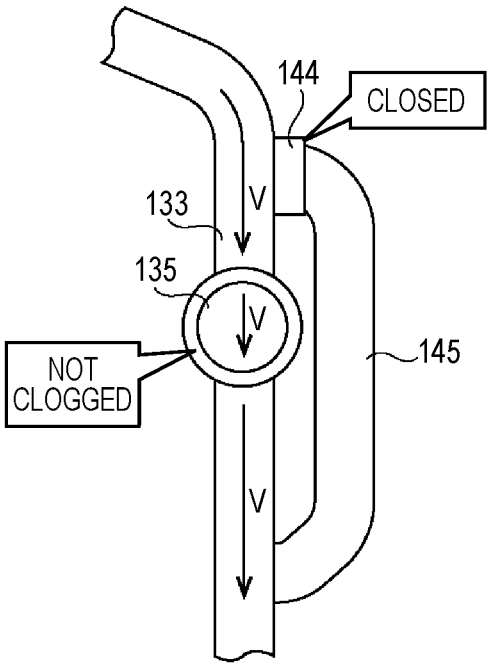
FIGS. 8A and 8B are explanatory diagrams showing a configuration on a drain side of a cooling device in related art.
Figure 8B:
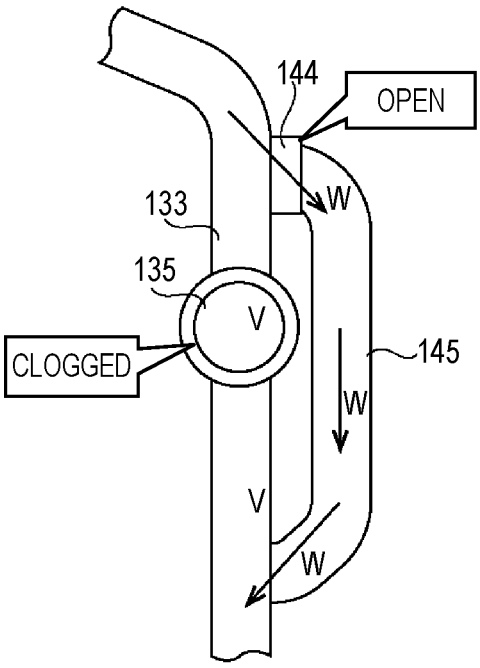

FIGS. 8A and 8B show a configuration equivalent to a configuration of a drain side of the cooling device in the related art described in the above Patent Literature 1. In FIGS. 8A and 8B, 133 is a drain passage. The drain passage 133 corresponds to the drain pipe in the cooling device described in the above Patent Document 1. 135 is a filtering device, 145 is a bypass passage, and 144 is a relief valve. When the filtering device 135 is not clogged, the relief valve 144 closes as shown in FIG. 8A. In this case, the cooling water flows through the drain passage 133 so as to pass through the filtering device 135 as indicated by an arrow V in FIG. 8A. On the other hand, when the filtering device 135 is clogged, the relief valve 144 opens as shown in FIG. 8B. In this case, the cooling water flows through the bypass passage 145 as indicated by an arrow Win FIG. 8B.

The inventors of the present application consider removing the relief valve 144 from the configuration on the drain side of the cooling device as shown in FIGS. 8A and 8B, for example. By removing the relief valve 144, the number of parts can be reduced, a manufacturing cost of the cooling device can be reduced, and occurrence of defects such as failure of the relief valve 144 and a burden of maintenance of the relief valve 144 can be eliminated. However, removing the relief valve 144 from the configuration on the drain side of the cooling device causes the following problems.

Figure 9A:
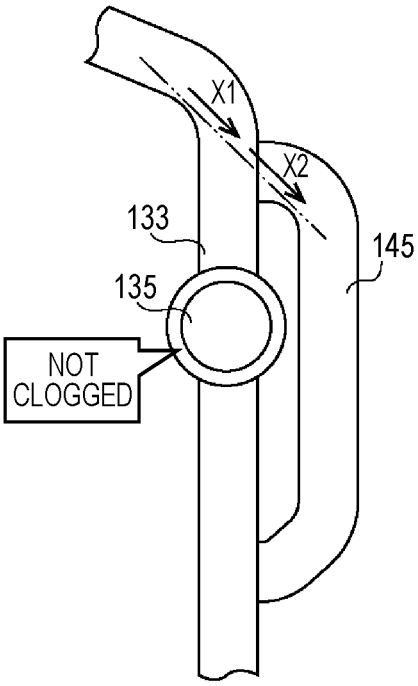
FIGS. 9A to 9C are explanatory diagram showing the configuration on the drain side of the cooling device with a relief valve removed.

FIG. 9A shows the configuration on the drain side of the cooling device shown in FIGS. 8A and 8B with the relief valve 144 removed. When the relief valve 144 is removed from the configuration on the drain side of the cooling device, an inlet of the bypass passage 145 is always in communication with the drain passage 133. Therefore, as indicated by arrows X1 and X2 in FIG. 9A, the cooling water may flow into the bypass passage 145 even when the filtering device 135 is not clogged. As shown by a two-dot chain line in FIG. 9A, this phenomenon is likely to occur when a linear flow path extending from the drain passage 133 toward the bypass passage 145 is formed at a branched portion where the bypass passage 145 branches from the drain passage 133, so that a flowing direction (the arrow X1) of the cooling water flowing from the drain passage 133 into the branched portion is the same as a flowing direction (the arrow X2) of the cooling water flowing from the branched portion into the bypass passage 145. In this way, even when the filtering device 135 is not clogged, an amount of the cooling water flowing through the filtering device 135 decreases when the cooling water flows into the bypass passage 145. As a result, ability of the cooling device for collecting the fine objects is reduced.

When the relief valve 144 is removed from the configuration on the drain side of the cooling device as shown in FIGS. 8A and 8B, there is a concern that the cooling water flowing through the bypass passage 145 may flow out from an outlet of the bypass passage 145 and then flow back to the drain passage 133, so that the fine objects accumulated in the filtering device 135 may be lifted up, sequentially flow through the bypass passage 145 and the drain passage 133 together with the cooling water, and be discharged out of the outboard motor.

Figure 9B:
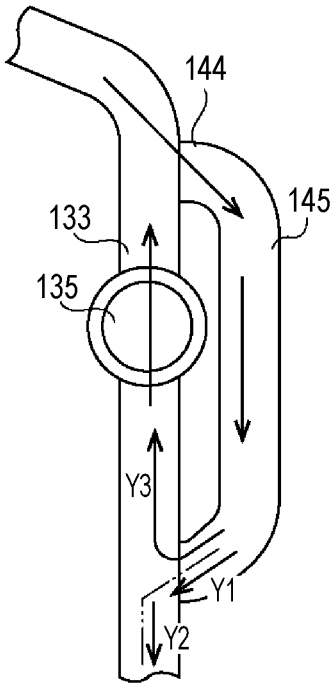

Similar to FIG. 9A, FIG. 9B shows the configuration on the drain side of the cooling device shown in FIGS. 8A and 8B with the relief valve 144 removed. The cooling water flowing through the bypass passage 145 normally flows out from the outlet of the bypass passage 145 and then flows downward through the drain passage 133 as indicated by arrows Y1 and Y2 in FIG. 9B. However, when the amount of the cooling water flowing through the bypass passage 145 is large, and the cooling water flowing through the bypass passage 145 flows out from the outlet of the bypass passage 145, the flow may be disturbed, and the cooling water may flow upward through the drain passage 133 as indicated by an arrow Y3 in FIG. 9B. As shown by a two-dot chain line in FIG. 9B, this backflow is likely to occur when a flow path from the bypass passage 145 to the drain passage 133 is curved at a confluence portion where the bypass passage 145 and the drain passage 133 join, so that a flowing direction (the arrow Y1) of the cooling water flowing from the bypass passage 145 into the confluence portion is different from a flowing direction (the arrow Y2) of the cooling water flowing downward from the confluence portion through the drain passage 133. When the cooling water flows back through the drain passage 133, there is a risk that the back-flowing cooling water flows from bottom to top through the filtering device 135, and the fine objects accumulated in the filtering device 135 are lifted up by this cooling water. In the configuration in which the relief valve 144 is removed, since the inlet of the bypass passage 145 is always in communication with the drain passage 133, the lifted up fine objects may enter the bypass passage 145 from the inlet of the bypass passage 145 together with the cooling water, sequentially flow downward through the bypass passage 145 and the drain passage 133, and be discharged out of the outboard motor. Such backflow of the cooling water may cause the fine objects that are temporarily accumulated in the filtering device 135 to be discharged out of the outboard motor, so that the backflow of the cooling water may lead to deterioration of the ability of the cooling device for collecting the fine objects.

When the relief valve 144 is removed from the configuration on the drain side of the cooling device as shown in FIGS. 8A and 8B, there is a concern that when a power source of the outboard motor is an engine, exhaust gas from the engine may flow back through the drain passage 133, so that the fine objects accumulated in the filtering device 135 may be lifted up, sequentially flow through the bypass passage 145 and the drain passage 133 together with the cooling water, and be discharged out of the outboard motor.

In other words, in most outboard motors that use an engine as a power source, an exhaust chamber is provided in a rear portion of a lower portion of the outboard motor, and exhaust gas discharged from the engine is sent to the exhaust chamber through an exhaust passage. When the outboard motor having such a configuration includes a water-cooled cooling device, the cooling device is often configured so that the cooling water flowing through the drain passage is discharged into the exhaust chamber. When the cooling device has such a configuration, since the drain passage and the exhaust passage are connected to each other via the exhaust chamber, when a pressure in the drain passage is lower than a pressure in the exhaust chamber, the exhaust gas sent from the exhaust passage into the exhaust chamber may flow from the exhaust chamber into the drain passage and flow back through the drain passage.

Figure 9C:
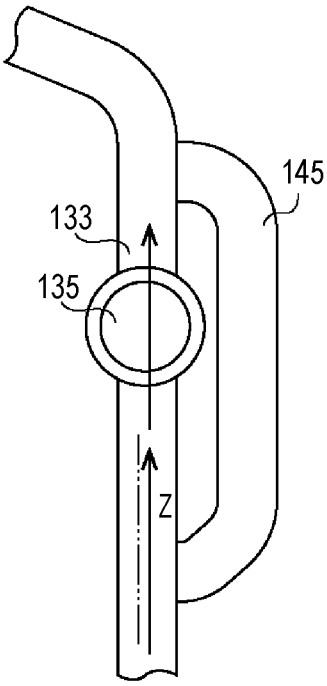

Similar to FIGS. 9A and 9B, FIG. 9C shows the configuration on the drain side of the cooling device shown in FIGS. 8A and 8B with the relief valve 144 removed. As indicated by an arrow Z in FIG. 9C, the exhaust gas flowing back through the drain passage 133 from the exhaust chamber may reach the filtering device 135 and flow through the filtering device 135 from bottom to top. The phenomenon that the exhaust gas flowing back through the drain passage 133 reaches the filtering device 135 is likely to occur when in the drain passage 133, a flow path from a lower side of the filtering device 135 to the filtering device 135 is linear as indicated by a two-dot chain line in FIG. 9C, so that the exhaust gas flowing back through the drain passage 133 flows in a linear shape toward the filtering device 135. When the exhaust gas flows through the filtering device 135 from bottom to top, the fine objects accumulated in the filtering device 135 may be lifted up by the exhaust gas, sequentially flow downward through the bypass passage 145 and the drain passage 133 together with the cooling water, and be discharged out of the outboard motor. Therefore, such backflow of the exhaust gas also leads to the deterioration of the ability of the cooling device for collecting the fine objects.

The present disclosure is made in view of, for example, the above-described problems, and an object of the present disclosure is to provide a cooling device for a ship propulsion machine that can sufficiently ensure ability for collecting fine objects even without using a valve that opens or closes a bypass passage depending on whether a collector (filtering device) is clogged or not.

A cooling device for a ship propulsion machine according to an embodiment of the present disclosure is a cooling device that is provided in a ship propulsion machine, takes water of an outside of the ship propulsion machine into the ship propulsion machine, cools a power source of the ship propulsion machine by flowing the taken water around or inside the power source as cooling water, and discharges the cooling water after flowing around or inside the power source to the outside of the ship propulsion machine, and includes: a drain passage for discharging the cooling water after flowing around or inside the power source to the outside of the ship propulsion machine; a collection passage provided between an upstream portion and a downstream portion of the drain passage and connecting the upstream portion and the downstream portion of the drain passage; a collector provided in a middle of the collection passage for collecting fine objects contained in the cooling water flowing through the collection passage from the upstream portion of the drain passage toward the downstream portion of the drain passage; a bypass passage provided in parallel with the collection passage between the upstream portion and the downstream portion of the drain passage and connecting the upstream portion and the downstream portion of the drain passage; a branched portion where the upstream portion of the drain passage is branched into the collection passage and the bypass passage; and a confluence portion where the collection passage and the bypass passage join the downstream portion of the drain passage.

In the cooling device according to the present embodiment, the upstream portion of the drain passage, the collection passage, and the bypass passage are arranged such that a difference between a flowing direction of the cooling water flowing from the upstream portion of the drain passage into the branched portion and a flowing direction of the cooling water flowing from the branched portion into the collection passage is smaller than a difference between the flowing direction of the cooling water flowing from the upstream portion of the drain passage into the branched portion and a flowing direction of the cooling water flowing from the branched portion into the bypass passage.

By arranging the upstream portion of the drain passage, the collection passage, and the bypass passage in this way, when the collector is not clogged, the cooling water flowing out from the upstream portion of the drain passage is more likely to flow into the collection passage than the bypass passage. Therefore, most of the cooling water flowing out from the upstream portion of the drain passage when the collector is not clogged can smoothly flow into the collection passage and be sent to the collector without using a valve or the like that opens or closes the bypass passage depending on whether the collector is clogged or not. That is, even when the upstream portion of the drain passage and an inlet of the bypass passage are always in communication with each other, the cooling water flowing out from the upstream portion of the drain passage can be prevented from flowing into the bypass passage when the collector is not clogged. Therefore, when the collector is not clogged, it is possible to prevent a decrease in an amount of the cooling water flowing through the collector by the cooling water flowing into the bypass passage, and to prevent a decrease in ability of the cooling device for collecting the fine objects.

In the cooling device according to the present embodiment, the downstream portion of the drain passage, the collection passage, and the bypass passage are arranged such that a difference between a flowing direction of the cooling water flowing from the bypass passage into the confluence portion and a flowing direction of the cooling water flowing from the confluence portion into the downstream portion of the drain passage is smaller than a difference between a flowing direction of the cooling water flowing from the collection passage into the confluence portion and a flowing direction of the cooling water flowing from the confluence portion into the downstream portion of the drain passage.

By arranging the downstream portion of the drain passage, the collection passage, and the bypass passage in this way, the flowing direction of the cooling water from the bypass passage into the downstream portion of the drain passage can be made linear or nearly linear. Therefore, when the collector is clogged, the cooling water can flow smoothly from the bypass passage to the downstream portion of the drain passage, and the cooling water flowing through the bypass passage can be prevented from flowing back through the collection passage. By arranging the downstream portion of the drain passage, the collection passage, and the bypass passage as described above, when exhaust gas flows backward through the downstream portion of the drain passage from an exhaust chamber of the ship propulsion machine, a flowing direction of the exhaust gas from the downstream portion of the drain passage into the bypass passage can be made linear or nearly linear, and a flowing direction of the exhaust gas from the downstream portion of the drain passage into the collection passage can be bent. Therefore, the exhaust gas flowing backward through the downstream portion of the drain passage from the exhaust chamber of the ship propulsion machine can smoothly flow to the bypass passage, and the exhaust gas flowing backward through the downstream portion of the drain passage is prevented from flowing back through the collection passage.

In this way, by preventing the backflow of the cooling water or the exhaust gas into the collection passage, and the cooling water or the exhaust gas passing through the collector from bottom to top, the fine objects accumulated in the collector can be prevented from being lifted up. Therefore, even when an inlet of the collection passage and the inlet of the bypass passage are always in communication with each other at the branched portion, the fine objects temporarily accumulated in the collector can be prevented from being lifted up and discharged to the outside of the ship propulsion machine through the bypass passage and the downstream portion of the drain passage. As described above, according to the present embodiment, even if a valve or the like that opens or closes the bypass passage depending on whether the collector is clogged or not is not provided, the fine objects temporarily accumulated in the collector can be prevented from being discharged to the outside of the ship propulsion machine by the backflow of the cooling water or the exhaust gas, and therefore, it is possible to sufficiently ensure the ability of the cooling device for collecting the fine objects.

<Embodiment>

Hereinafter, an embodiment of the cooling device for a ship propulsion machine according to the present disclosure will be described with reference to FIGS. 1 to 7. Note that in this embodiment, front (Fd), back (Bd), upper (Ud), down (Dd), left (Ld), and right (Rd) directions are described following arrows drawn at a bottom left in FIGS. 1 to 7.

<Outboard Motor>

Figure 1:
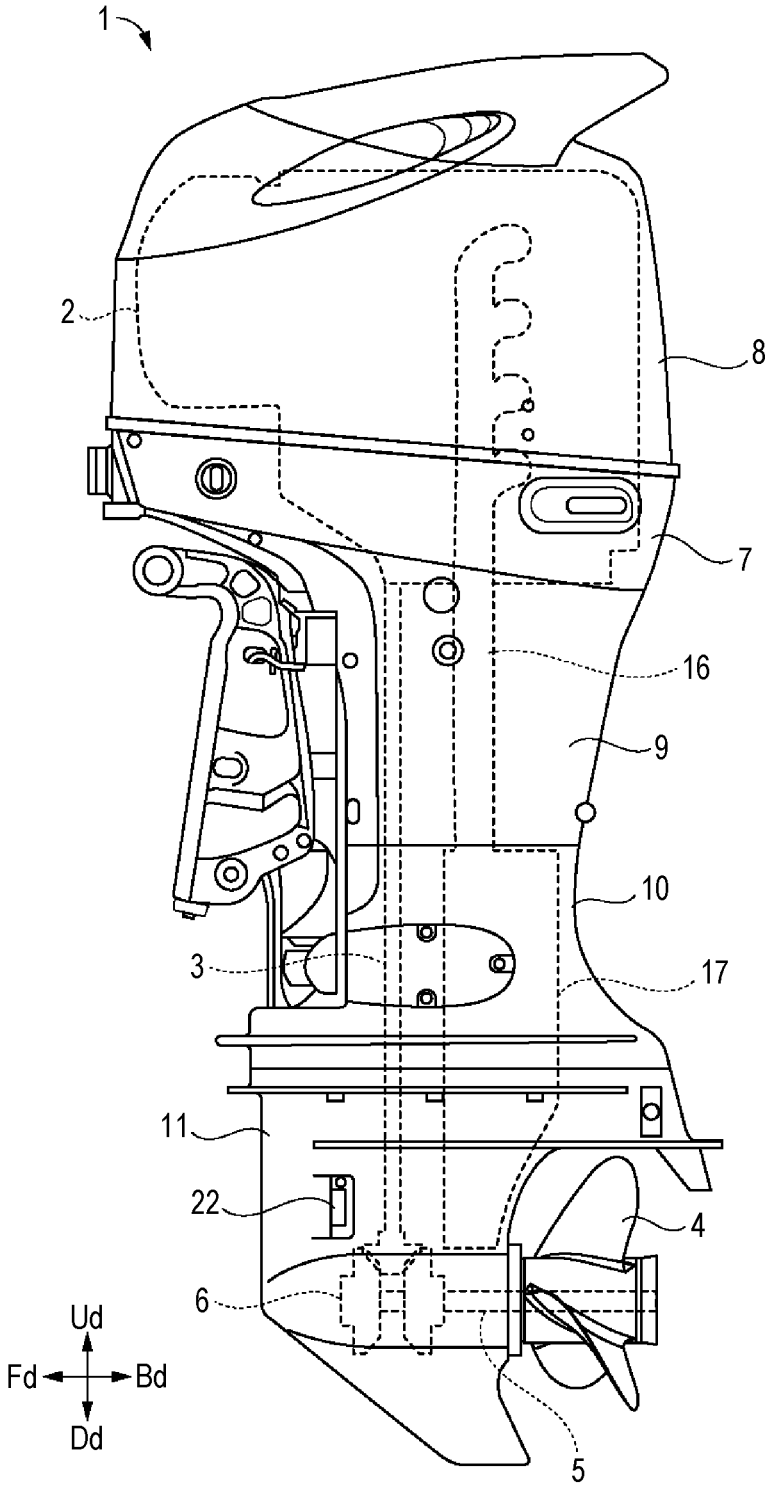
FIG. 1 is an overall view showing an outboard motor provided with a cooling device according to an embodiment of the present disclosure.

FIG. 1 shows an overall outboard motor 1, which is one form of the ship propulsion machine, as viewed from a left side. As shown in FIG. 1, the outboard motor 1 includes an engine 2 as a power source, a drive shaft 3 that receives power from the engine 2 and then rotates, a propeller 4 that generates a propulsion force for a vessel, a propeller shaft 5 attached with the propeller 4, and a gear mechanism 6 that transmits the rotation of the drive shaft 3 to the propeller shaft 5. Although not shown, the gear mechanism 6 is provided with a shift device for switching a direction of the rotation transmitted from the drive shaft 3 to the propeller shaft 5. The engine 2 is disposed on an upper portion of the outboard motor 1. The gear mechanism 6, propeller shaft 5, and propeller 4 are arranged on a lower portion of the outboard motor 1. The drive shaft 3 extends in an up-down direction between the engine 2 and the gear mechanism 6.

A lower portion of the engine 2 is covered with an engine bottom cover 7, and an up-down direction intermediate portion and an upper portion of the engine 2 is covered with an engine top cover 8. The engine top cover 8 is attached to the engine bottom cover 7 in a detachable manner. By removing the engine top cover 8, it is possible to expose a wide range of parts of the engine 2 from the up-down direction intermediate portion to the upper portion. An upper portion of the drive shaft 3 is covered with an upper case 9, and an up-down direction intermediate portion of the drive shaft 3 is covered with a middle case 10. A lower portion of the drive shaft 3, the gear mechanism 6, and a front portion of the propeller shaft 5 are covered with a lower case 11.

Figure 2:
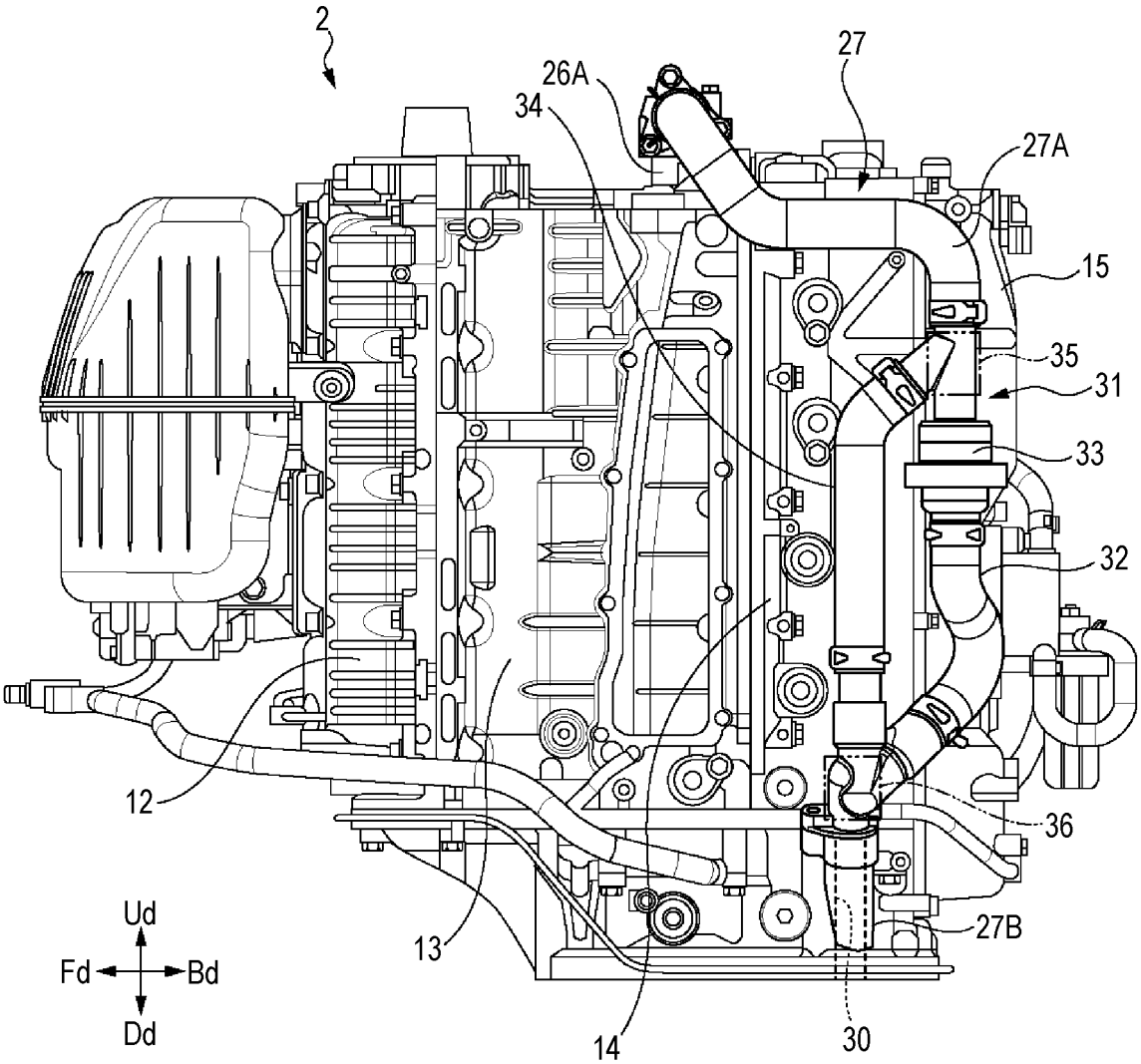
FIG. 2 is an external view of an engine of the outboard motor according to the embodiment of the present disclosure as viewed from a left side.
Figure 3:
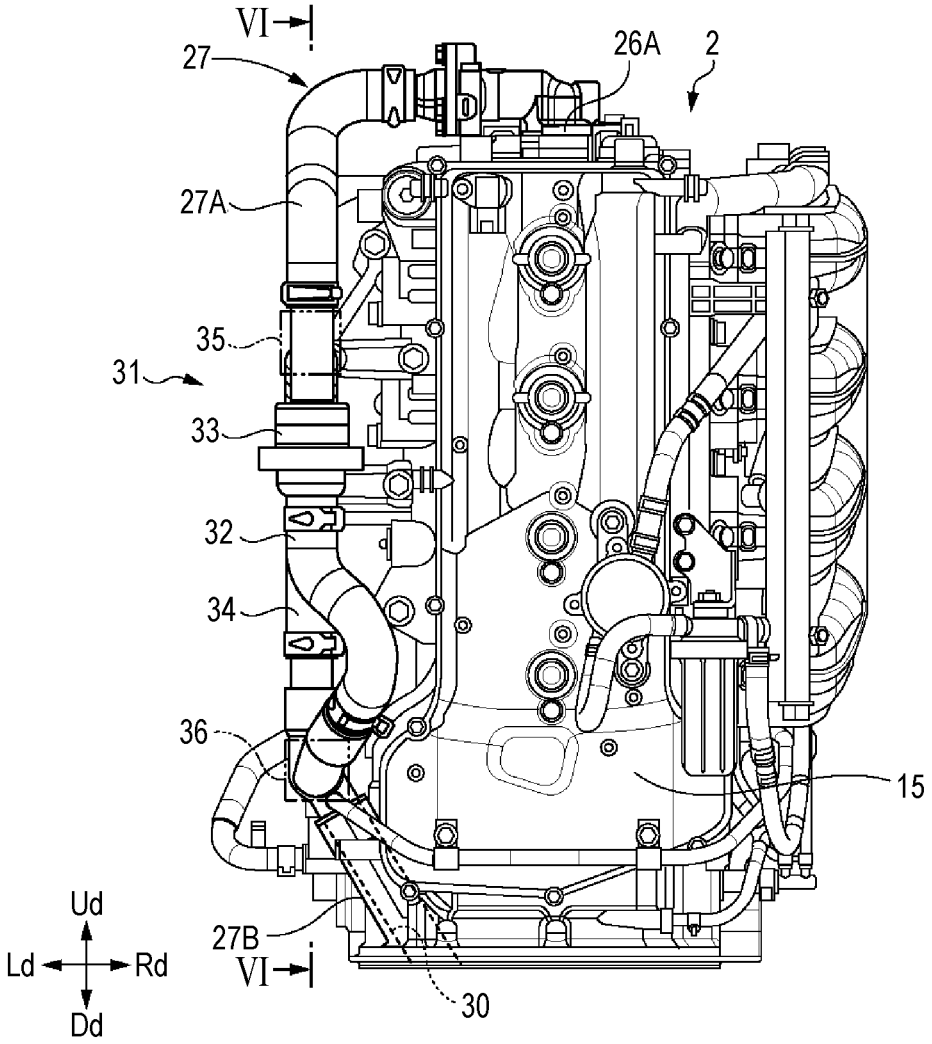
FIG. 3 is an external view of the engine in FIG. 2 as viewed from a back side.

FIG. 2 shows the engine 2 as viewed from the left side. FIG. 3 shows the engine 2 as viewed from a back side. The engine 2 is, for example, a 4-cycle 4-cylinder gasoline engine, and a cooling method of the engine 2 is water cooling. The engine 2 is disposed such that an extending direction of a crankshaft is the up-down direction. As shown in FIG. 2, a crankcase 12 is disposed at a front portion of the engine 2, a cylinder block 13 is disposed behind the crankcase 12, and a cylinder head 14 is disposed behind the cylinder block 13. A rear portion of the cylinder head 14 is covered with a cylinder head cover 15.

As shown in FIG. 1, the outboard motor 1 is provided with an exhaust passage 16 for discharging exhaust gas discharged from the engine 2 to the outside of the outboard motor 1. An upper end side of the exhaust passage 16 is connected to an exhaust port provided in the cylinder head 14 of the engine 2, and a lower end side of the exhaust passage 16 is connected to an exhaust chamber 17 provided in a rear portion of a lower portion of the outboard motor 1. In the outboard motor 1 of the present embodiment, the exhaust chamber 17 is provided in a part extending from a rear portion of the middle case 10 to a rear portion of the lower case 11. The exhaust gas discharged from the exhaust port of the engine 2 is sent to the exhaust chamber 17 through the exhaust passage 16, and then discharged to the outside of the outboard motor 1 through, for example, a discharge port provided in a shaft portion of the propeller 4. Note that in FIGS. 2 and 3, illustration of the exhaust port of the engine 2 and the exhaust passage 16 is omitted.

<Cooling Device>

Figure 4:
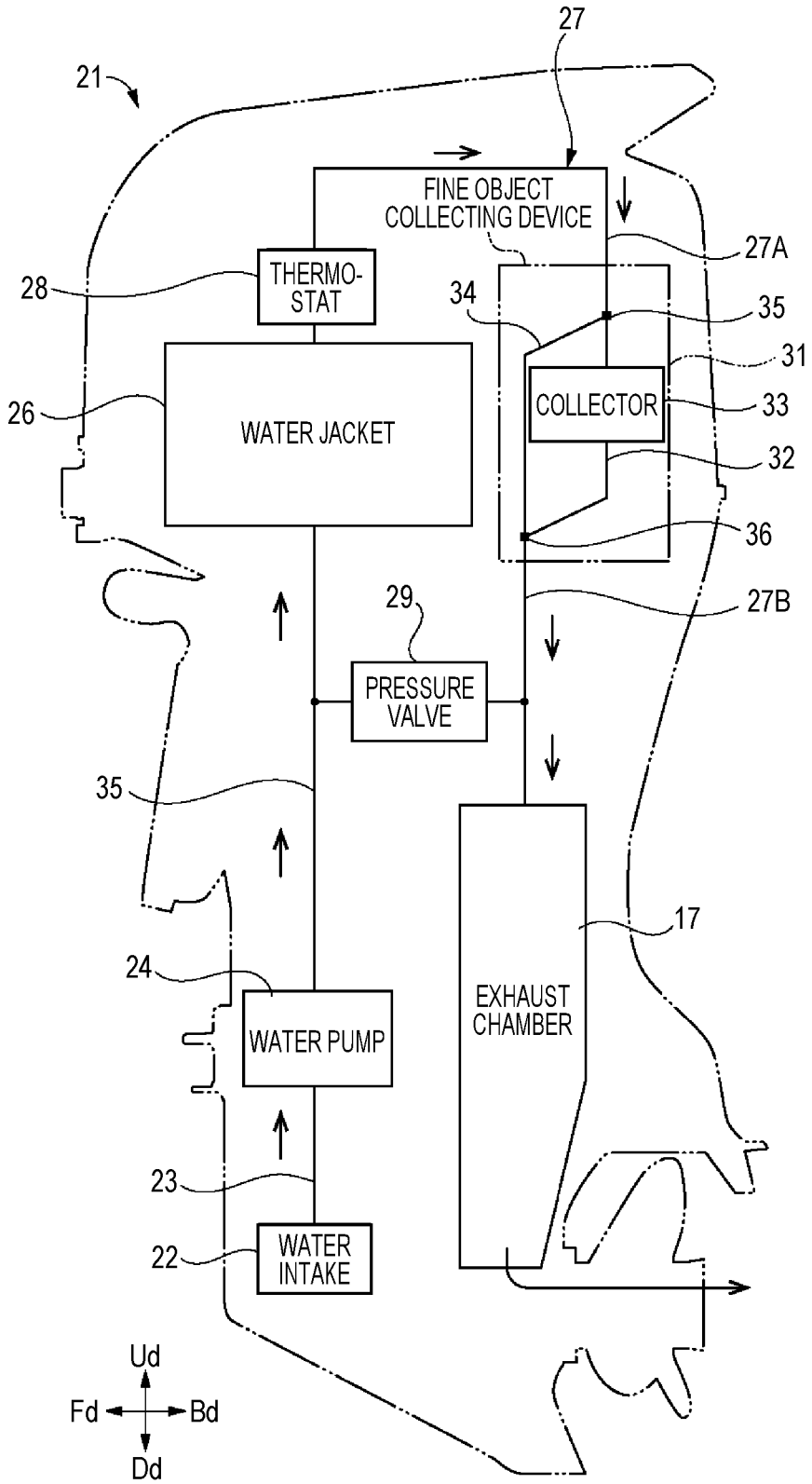
FIG. 4 is an explanatory diagram showing a configuration of the cooling device according to the embodiment of the present disclosure.

The outboard motor 1 includes a cooling device 21 for cooling the engine 2 and other heat-generating portions of the outboard motor 1 by using water around the outboard motor 1, such as sea water, lake water, or river water, as cooling water. FIG. 4 shows a configuration of the cooling device 21.

As shown in FIG. 4, the cooling device 21 includes a water intake 22, a water intake passage 23, a water pump 24, a water supply passage 25, a water jacket 26, a drain passage 27, a thermostat 28, a pressure valve 29, and a fine object collecting device 31.

The water intake 22 is a port for taking in water around the outboard motor 1 into the outboard motor 1, and is provided in a portion of the outboard motor 1 that is submerged under water, specifically a part of the lower case 11 (see FIG. 1). The water intake 22 includes a strainer or a cover provided with a large number of small holes for preventing objects larger than fine objects, such as stones and algae, from entering the outboard motor 1 together with sea water, lake water, river water, or the like.

The water intake passage 23 is a passage for allowing the water pump 24 to absorb water taken into the outboard motor 1 from the water intake 22, and is provided inside the lower case 11.

The water pump 24 is a pump that absorbs water taken into the outboard motor 1 from the water intake 22 and discharges the absorbed water as the cooling water, and is provided, for example, inside the lower case 11 or the middle case 10. The water pump 24 operates using the rotation of the drive shaft 3.

The water supply passage 25 is a passage for supplying the cooling water discharged from the water pump 24 to the water jacket 26, and is, for example, constituted by hoses or pipes provided inside the middle case 10, upper case 9, and engine bottom cover 7.

The water jacket 26 is a mechanism for cooling the engine 2 by causing the cooling water supplied through the water supply passage 25 to flow around or inside the engine 2, and is provided around or inside the engine 2.

The drain passage 27 is a passage for discharging the cooling water after flowing through the water jacket 26 to the outside of the outboard motor 1, and is constituted by, for example, hoses or pipes provided inside the engine top cover 8, engine bottom cover 7, upper case 9, and the like. The fine object collecting device 31 is provided in a middle of the drain passage 27, so that the drain passage 27 is divided into an upstream portion 27A, which is a portion on an upstream side of the fine object collecting device 31, and a downstream portion 27B, which is a portion on a downstream side of the fine object collecting device 31.

As shown in FIGS. 2 and 3, the upstream portion 27A of the drain passage 27 is disposed in a region from above the cylinder head 14 to left of the upper portion of the cylinder head cover 15. The upstream portion 27A of the drain passage 27 is made of a resin pipe having high heat resistance and rigidity, a metal pipe having high corrosion resistance, or a rubber hose having high heat resistance and rigidity. An upper end portion of the upstream portion 27A of the drain passage 27 is connected to an outlet 26A of the water jacket 26 disposed on an upper portion of the cylinder head 14. The upstream portion 27A of the drain passage 27 extends leftward from the outlet 26A of the water jacket 26 and then bends, then extends rearward while tilting downward on the left side of the rear upper portion of the engine 2, and then bends, then extends horizontally rearward on the left side of the upper rear portion of the engine 2 and then bends, and then extends vertically downward on the left side of the upper rear portion of the engine 2. A port at a lower end of the upstream portion 27A of the drain passage 27 faces downward. Upper end portions of the collection passage 32 and the bypass passage 34 of the fine object collecting device 31 (specifically, upper end portions of an inflow pipe portion 41A of a branched pipe 41) are connected to the lower end portion of the upstream portion 27A of the drain passage 27.

The downstream portion 27B of the drain passage 27 is disposed in a region from a lower left portion of the rear portion of the engine 2 to the exhaust chamber 17. An upper end portion of the downstream portion 27B of the drain passage 27 is formed by a drain hole 30 formed in a lower left portion of a rear portion of a housing of the engine 2. The drain hole 30 is slightly inclined to the right side, but extends downward, and a port of an upper end of the drain hole 30 faces upward. The upper end portion of the drain hole 30 is connected to lower end portions of the collection passage 32 and the bypass passage 34 (specifically, lower end portions of an outflow pipe portion 54C of a confluence pipe 54). A portion of the downstream portion 27B of the drain passage 27 below the drain hole 30 is formed by hoses, pipes, or the like provided inside the engine bottom cover 7, upper case 9, and the like. A lower end portion of the downstream portion of the drain passage 27 is connected to the exhaust chamber 17 as shown in FIG. 4.

The thermostat 28 is a device that restricts the flow of the cooling water in order to warm up the engine 2 or prevent overcooling of the engine 2, and is provided near the outlet 26A of the water jacket 26, for example. The thermostat 28 opens when a temperature of the cooling water flowing through the water jacket 26 reaches or exceeds a predetermined reference temperature, and closes when the temperature of the cooling water falls below the reference temperature.

The pressure valve 29 is a valve for lowering water pressure in the water supply passage 25 or the water jacket 26 by releasing the cooling water discharged from the water pump 24 to the exhaust chamber 17 side when the flow of cooling water is restricted by the thermostat 28. The pressure valve 29 is, for example, a normally closed valve, and opens when the water pressure in the water supply passage 25 exceeds a predetermined reference pressure.

The fine object collecting device 31 is a device that collects the fine objects contained in sea water, lake water, river water, and the like taken into the outboard motor 1 from the outside of the outboard motor 1 and used as the cooling water for cooling the engine 2. The fine object collecting device 31 will be described in detail later.

In the cooling device 21 having such a configuration, when the water pump 24 is in operation, the thermostat 28 is open, and the pressure valve 29 is closed, the water around the outboard motor 1 is taken into the outboard motor 1 through the water intake 22, flows through the water intake passage 23 and the water supply passage 25 in sequence, and is sent to the water jacket 26 as the cooling water. The cooling water sent to the water jacket 26 flows through the water jacket 26 to cool the engine 2. The cooling water flowing through the water jacket 26 flows into the upstream portion 27A of the drain passage 27 from the outlet 26A of the water jacket 26, flows through the upstream portion 27A of the drain passage 27, then flows through the fine object collecting device 31, then flows through the downstream portion 27B of the drain passage 27 and is then discharged into the exhaust chamber 17. The cooling water discharged into the exhaust chamber 17 is discharged out of the outboard motor 1 together with the exhaust gas through, for example, a discharge port provided in the shaft portion of the propeller 4. On the other hand, when the water pump 24 is in operation, the thermostat 28 is closed, and the pressure valve 29 is open, the water taken into the outboard motor 1 through the water intake 22 sequentially flows through the water intake passage 23 and the water supply passage 25, but before reaching the water jacket 26, the water is sent to the exhaust chamber 17 side through the open pressure valve 29 and discharged into the exhaust chamber 17. The cooling water discharged into the exhaust chamber 17 is discharged to the outside of the outboard motor 1 together with the exhaust gas.

<Fine Object Collecting Device>

As described above, the fine object collecting device 31 is a device that collects the fine objects contained in sea water, lake water, river water, and the like taken into the outboard motor 1 from the outside of the outboard motor 1 and used as the cooling water for cooling the engine 2. The fine object collecting device 31 is arranged on a left side of the rear portion of the engine 2 as shown in FIGS. 2 and 3. The fine object collecting device 31 is arranged inside the engine top cover 8.

The fine objects are, for example, fine waste such as microplastics, and dregs of feed used in aquaculture. A size of the fine objects is, for example, approximately 0.1 mm or more and 5 mm or less. Due to such a size, the fine objects are not removed by a strainer or a cover formed with a plurality of pores provided at the water intake 22. That is, when the water pump 24 is in operation, the thermostat 28 is open, and the pressure valve 29 is closed, the fine objects enter the outboard motor 1 from the water intake 22 together with sea water, lake water, river water, or the like, and then enter the fine object collecting device 31 after flowing through the water intake passage 23, the water supply passage 25, the water jacket 26, and the upstream portion 27A of the drain passage 27.

Figure 5:
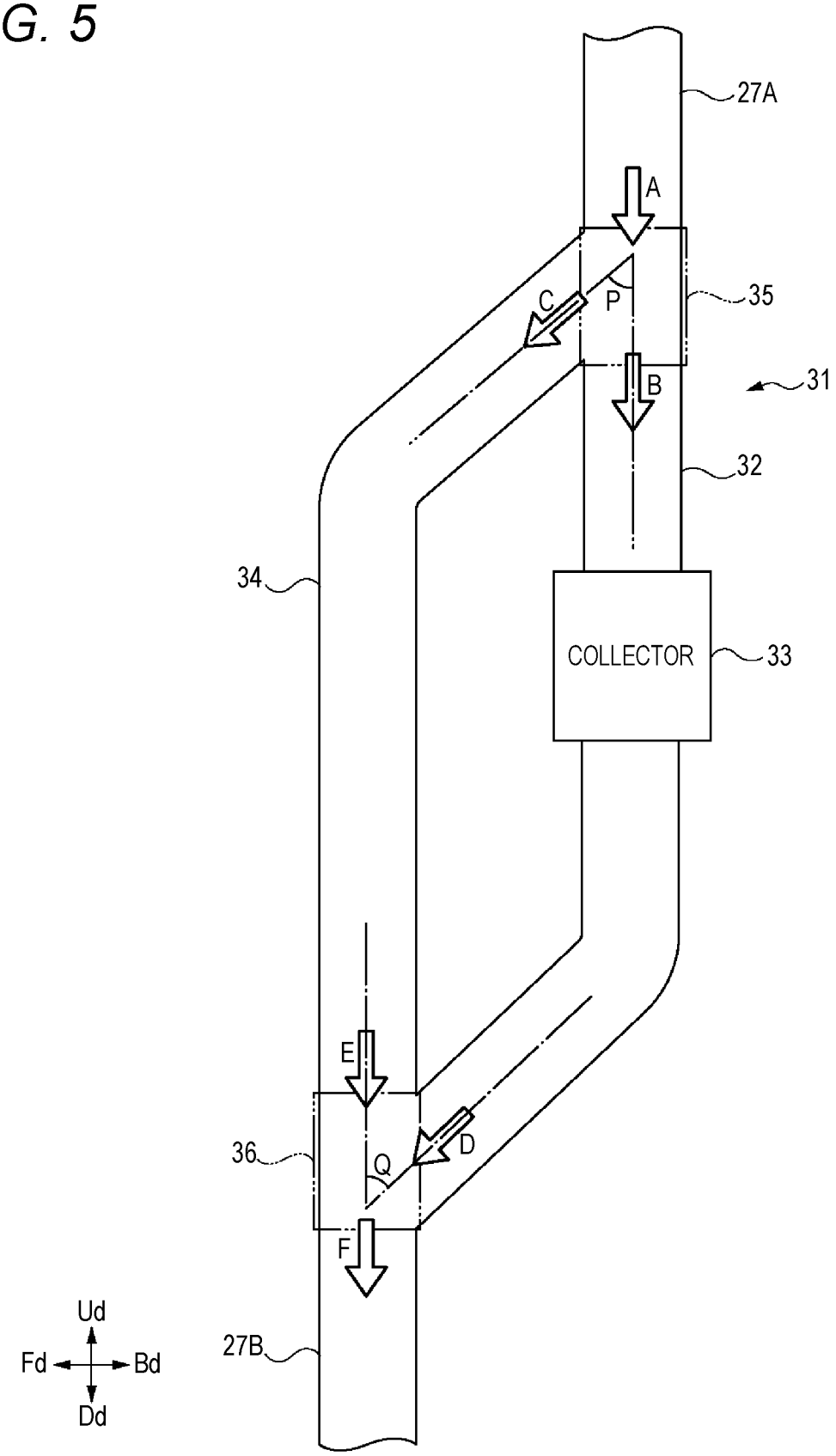
FIG. 5 is an explanatory diagram showing a basic configuration of a fine object collecting device in the cooling device according to the embodiment of the present disclosure.

FIG. 5 shows a basic configuration of the fine object collecting device 31. As shown in FIG. 5, the fine object collecting device 31 includes the collection passage 32, a collector 33, the bypass passage 34, a branched portion 35, and a confluence portion 36.

The collection passage 32 is a passage provided between the upstream portion 27A and the downstream portion 27B of the drain passage 27 and connecting the upstream portion 27A and the downstream portion 27B of the drain passage 27. The collection passage 32 allows the cooling water flowing through the upstream portion 27A of the drain passage 27 to flow to the downstream portion 27B of the drain passage 27 via the collector 33.

The collector 33 is a device that is provided in a middle of the collection passage 32, and collects the fine objects contained in the cooling water flowing through the collection passage 32 from the upstream portion 27A of the drain passage 27 toward the downstream portion 27B of the drain passage 27. As will be described later, the collector 33 collects the fine objects in the cooling water and removes the fine objects from the cooling water by passing the cooling water flowing through the collection passage 32 through a filter 43.

The bypass passage 34 is a passage provided in parallel with the collection passage 32 between the upstream portion 27A and the downstream portion 27B of the drain passage 27 and connecting between the upstream portion 27A and the downstream portion 27B of the drain passage 27. The bypass passage 34 allows the cooling water flowing through the upstream portion 27A of the drain passage 27 to flow to the downstream portion 27B of the drain passage 27 without passing through the collector 33 when the filter 43 of the collector 33 is clogged or the like.

The branched portion 35 is a portion where the upstream portion 27A of the drain passage 27 branches into the collection passage 32 and the bypass passage 34. The confluence portion 36 is a portion where the collection passage 32 and the bypass passage 34 join the downstream portion 27B of the drain passage 27.

<Arrangement of Collection Passage, Bypass Passage, and the Like at Branched Portion>

In FIG. 5, the upstream portion 27A of the drain passage 27, the collection passage 32, and the bypass passage 34 are arranged such that a difference between a flowing direction of the cooling water flowing from the upstream portion 27A of the drain passage 27 into the branched portion 35 and a flowing direction of the cooling water flowing from the branched portion 35 into the collection passage 32 is smaller than a difference between the flowing direction of the cooling water flowing from the upstream portion 27A of the drain passage 27 into the branched portion 35 and a flowing direction of the cooling water flowing from the branched portion 35 into the bypass passage 34.

Specifically, the upstream portion 27A of the drain passage 27 and the collection passage 32 are arranged such that the flowing direction of the cooling water flowing from the upstream portion 27A of the drain passage 27 into the branched portion 35 is the same as the flowing direction of the cooling water flowing from the branched portion 35 into the collection passage 32. On the other hand, the upstream portion 27A of the drain passage 27 and the bypass passage 34 are arranged such that the flowing direction of the cooling water flowing from the upstream portion 27A of the drain passage 27 into the branched portion 35 is different from the flowing direction of the cooling water flowing from the branched portion 35 into the bypass passage 34.

More specifically, as shown by an arrow A, the upstream portion 27A of the drain passage 27 is arranged such that the flowing direction of the cooling water flowing from the upstream portion 27A of the drain passage 27 into the branched portion 35 is downward and vertical. As shown by an arrow B, the collection passage 32 is arranged such that the flowing direction of the cooling water flowing from the branched portion 35 into the collection passage 32 is downward and vertical. On the other hand, as shown by an arrow C, the bypass passage 34 is arranged such that the flowing direction of the cooling water flowing from the branched portion 35 into the bypass passage 34 is not vertical.

In the present embodiment, a lower end portion of the upstream portion 27A of the drain passage 27 and an upper end portion of the collection passage 32, which are connected to each other at the branched portion 35, both extend vertically and are arranged coaxially with each other. As a result, a vertically extending linear flow path is formed from the lower end portion of the upstream portion 27A of the drain passage 27 to the upper end portion of the collection passage 32. On the other hand, an upper end portion of the bypass passage 34 connected to the lower end portion of the upstream portion 27A of the drain passage 27 at the branched portion 35 is inclined with respect to a vertical direction. As a result, a bent flow path is formed from the lower end portion of the upstream portion 27A of the drain passage 27 to the upper end portion of the bypass passage 34.

The collection passage 32 and the bypass passage 34 intersect each other at an acute angle at the branched portion 35. An angle P between the upper end portion of the collection passage 32 and the upper end portion of the bypass passage 34 is, for example, approximately 20 degrees or more and less than 90 degrees. Note that the upper end portion of the bypass passage 34 may extend horizontally, and the collection passage 32 and the bypass passage 34 may intersect each other at a right angle at the branched portion 35, and in this case, P is 90 degrees.

<Arrangement of Collection Passage, Bypass Passage, and the Like at Confluence Portion>

The collection passage 32, the bypass passage 34, and the downstream portion 27B of the drain passage 27 are arranged such that a difference between a flowing direction of the cooling water flowing from the bypass passage 34 into the confluence portion 36 and a flowing direction of the cooling water flowing from the confluence portion 36 into the downstream portion 27B of the drain passage 27 is smaller than a difference between a flowing direction of the cooling water flowing from the collection passage 32 into the confluence portion 36 and a flowing direction of the cooling water flowing from the confluence portion 36 into the downstream portion 27B of the drain passage 27.

Specifically, the bypass passage 34 and the downstream portion 27B of the drain passage 27 are arranged such that the flowing direction of the cooling water flowing from the bypass passage 34 into the confluence portion 36 is substantially the same as the flowing direction of the cooling water flowing from the confluence portion 36 into the downstream portion 27B of the drain passage 27. On the other hand, the collection passage 32 and the downstream portion 27B of the drain passage 27 are arranged such that the flowing direction of the cooling water flowing from the collection passage 32 into the confluence portion 36 is different from the flowing direction of the cooling water flowing from the confluence portion 36 into the downstream portion 27B of the drain passage 27.

Note that the reason why the relation between the flowing direction of the cooling water flowing from the bypass passage 34 into the confluence portion 36 and the flowing direction of the cooling water flowing from the confluence portion 36 into the downstream portion 27B of the drain passage 27 is expressed as "substantially the same" is that as shown in FIG. 3, when the engine 2 is viewed from a back side, the upper end portion (drain hole 30) of the downstream portion 27B of the drain passage 27 is slightly inclined to the right side with respect to the vertical direction. The matter that the upper end portion of the downstream portion 27B of the drain passage 27 is slightly inclined to the right side with respect to the vertical direction hardly reduces the effect of the cooling device 21 of the present embodiment that the cooling water flowing through the bypass passage 34 can be prevented from flowing back to the collection passage 32, and also hardly reduces the effect of the cooling device 21 of the present embodiment that the exhaust gas flowing back from the exhaust chamber 17 can be prevented from flowing into the collection passage 32 from the lower end portion of the collection passage 32.

More specifically, as shown by an arrow E, the bypass passage 34 is arranged such that the flowing direction of the cooling water flowing from the bypass passage 34 into the confluence portion 36 is downward and vertical. As shown by an arrow F, the downstream portion 27B of the drain passage 27 is arranged such that the flowing direction of the cooling water flowing from the confluence portion 36 into the downstream portion 27B of the drain passage 27 is downward and substantially vertical. On the other hand, as shown by an arrow D, the collection passage 32 is arranged such that the flowing direction of the cooling water flowing from the collection passage 32 into the confluence portion 36 is not vertical.

In the present embodiment, a lower end portion of the bypass passage 34 and an upper end portion of the downstream portion 27B of the drain passage 27 are connected to each other at the confluence portion 36, the lower end portion of the bypass passage 34 extends vertically, the upper end portion of the downstream portion 27B of the drain passage 27 extends substantially vertically, and the lower end portion of the bypass passage 34 and the upper end portion of the downstream portion 27B of the drain passage 27 are arranged substantially coaxially with each other. As a result, a substantially vertically extending and substantially linear flow path is formed from the lower end portion of the bypass passage 34 to the upper end portion of the downstream portion 27B of the drain passage 27. On the other hand, the lower end portion of the collection passage 32 connected to the upper end portion of the downstream portion 27B of the drain passage 27 at the confluence portion 36 is inclined with respect to the vertical direction. As a result, a bent flow path is formed from the lower end portion of the collection passage 32 to the upper end portion of the downstream portion 27B of the drain passage 27.

The collection passage 32 and the bypass passage 34 intersect each other at an acute angle at the confluence portion 36. An angle Q between the lower end portion of the collection passage 32 and the lower end portion of the bypass passage 34 is, for example, approximately 20 degrees or more and less than 90 degrees. Note that the lower end portion of the collection passage 32 may extend horizontally, and the collection passage 32 and the bypass passage 34 may intersect each other at a right angle at the confluence portion 36, and in this case, Q is 90 degrees.

The collection passage 32 extends vertically and downward from the branched portion 35, then is bent, then extends downward while being inclined with respect to the vertical direction, and reaches the confluence portion 36. The collector 33 is provided in a middle of a portion extending vertically of the collection passage 32. The bypass passage 34 extends downward from the branched portion 35 while being inclined with respect to the vertical direction, then is bent, then extends vertically and downward, and reaches the confluence portion 36.

<Flow of Cooling Water in Fine Object Collecting Device>

In FIG. 5, both the lower end portion of the upstream portion 27A of the drain passage 27 and the upper end portion of the collection passage 32 extend vertically. The lower end portion of the upstream portion 27A of the drain passage 27 and the upper end portion of the collection passage 32 are arranged coaxially with each other, and a vertically extending linear flow path is formed from the lower end portion of the upstream portion 27A of the drain passage 27 to the upper end portion of the collection passage 32. Therefore, the flowing direction of the cooling water flowing from the upstream portion 27A of the drain passage 27 into the branched portion 35 and the flowing direction of the cooling water flowing from the branched portion 35 into the collection passage 32 are both are downward and vertical, and are the same as each other as indicated by the arrows A and B. On the other hand, the upper end portion of the bypass passage 34 is inclined with respect to the vertical direction, and a bent flow path is formed from the lower end portion of the upstream portion 27A of the drain passage 27 to the upper end portion of the bypass passage 34. Therefore, the flowing direction of the cooling water flowing from the branched portion 35 into the bypass passage 34 is not vertical as indicated by the arrow C. As a result, the flowing direction of the cooling water flowing from the upstream portion 27A of the drain passage 27 into the branched portion 35 is different from the flowing direction of the cooling water flowing from the branched portion 35 into the bypass passage 34. Therefore, when the filter 43 of the collector 33 is not clogged, most of the cooling water flowing from the upstream portion 27A of the drain passage 27 into the branched portion 35 flows into the collection passage 32. The cooling water flowing into the collection passage 32 passes through the filter 43 inside the collector 33. The fine objects in the cooling water are removed as the cooling water passes through the filter 43. The cooling water passing through the filter 43 flows through the lower portion of the collection passage 32 and the confluence portion 36 in sequence and then into the downstream portion 27B of the drain passage 27. In this way, according to the present embodiment, when the filter 43 of the collector 33 is not clogged, most of the cooling water flowing out from the upstream portion 27A of the drain passage 27 can flow into the collection passage 32 and be sent to the collector 33 without using a valve or the like that opens or closes the bypass passage 34 depending on whether the filter 43 of the collector 33 is clogged or not.

On the other hand, when the filter 43 of the collector 33 is clogged, it becomes difficult for the cooling water to pass through the filter 43, and the flow of the cooling water is stagnant in the collector 33 and in the upper portion of the collector passage 32 (a portion above the collector 33). Therefore, when the filter 43 of the collector 33 is clogged, most of the cooling water flowing from the upstream portion 27A of the drain passage 27 into the branched portion 35 flows into the bypass passage 34, passes through the bypass passage 34 and the confluence portion 36 in sequence, and then flows into the downstream portion 27B of the drain passage 27. Here, the lower end portion of the bypass passage 34 extends vertically, the upper end portion of the downstream portion 27B of the drain passage 27 extends substantially vertically, and the lower end portion of the bypass passage 34 and the upper end portion of the downstream portion 27B of the drain passage 27 are arranged substantially coaxially with each other. As a result, a substantially vertically extending and substantially linear flow path is formed from the lower end portion of the bypass passage 34 to the upper end portion of the downstream portion 27B of the drain passage 27. Therefore, the flowing direction of the cooling water flowing from the bypass passage 34 into the confluence portion 36 and the flowing direction of the cooling water flowing from the confluence portion 36 into the downstream portion 27B of the drain passage 27 are both downward and substantially vertical, and are substantially the same as each other. Therefore, the cooling water smoothly flows downward in a substantially linear shape and in a substantially vertical direction from the bypass passage 34 to the downstream portion 27B of the drain passage 27. Therefore, according to the present embodiment, it is possible to prevent the flow of the cooling water flowing from the bypass passage 34 into the confluence portion 36 from being disturbed and flowing back through the collection passage 32 from the lower end portion of the bypass passage 34. Therefore, it is possible to prevent the fine objects accumulated in the filter 43 of the collector 33 from being lifted up by the cooling water passing through the collector 33 from bottom to top.

<Flow of Exhaust Gas Flowing Back from Exhaust Chamber>

As shown in FIGS. 1 and 4, the exhaust chamber 17 of the outboard motor 1 is connected to the exhaust passage 16 and the downstream portion 27B of the drain passage 27. As a result, the exhaust passage 16 and the downstream portion 27B of the drain passage 27 are connected to each other via the exhaust chamber 17. Therefore, when the pressure in the downstream portion 27B of the drain passage 27 becomes lower than the pressure in the exhaust chamber 17, the exhaust gas sent from the exhaust passage 16 into the exhaust chamber 17 may flow from the exhaust chamber 17 into the downstream portion 27B of the drain passage 27, and flow back through the downstream portion 27B of the drain passage 27. In the outboard motor 1, both the lower end portion of the bypass passage 34 and the upper end portion of the downstream portion 27B of the drain passage 27 extend substantially vertically. The lower end portion of the bypass passage 34 and the upper end portion of the downstream portion 27B of the drain passage 27 are arranged substantially coaxially with each other, and a substantially vertically extending and substantially linear flow path is formed from the lower end portion of the bypass passage 34 to the upper end portion of the downstream portion 27B of the drain passage 27. Therefore, most of the exhaust gas flowing backward through the downstream portion 27B of the drain passage 27 flows substantially linearly from bottom to top through this substantially linear flow path. That is, most of the back-flowing exhaust gas smoothly flows from the downstream portion 27B of the drain passage 27 into the bypass passage 34. Then, the exhaust gas flowing into the bypass passage 34 flows from bottom to top through the bypass passage 34, then passes through the branched portion 35 and flows to the upstream portion 27A of the drain passage 27. As described above, according to the present embodiment, it is possible to prevent the exhaust gas flowing backward through the downstream portion 27B of the drain passage 27 from flowing into the collection passage 32, and it is possible to prevent the fine objects accumulated in the filter 43 of the collector 33 from being lifted up by the back-flowing exhaust gas passing through the collector 33 from bottom to top.

<Details of Configuration of Fine Object Collecting Device>

Figure 6:
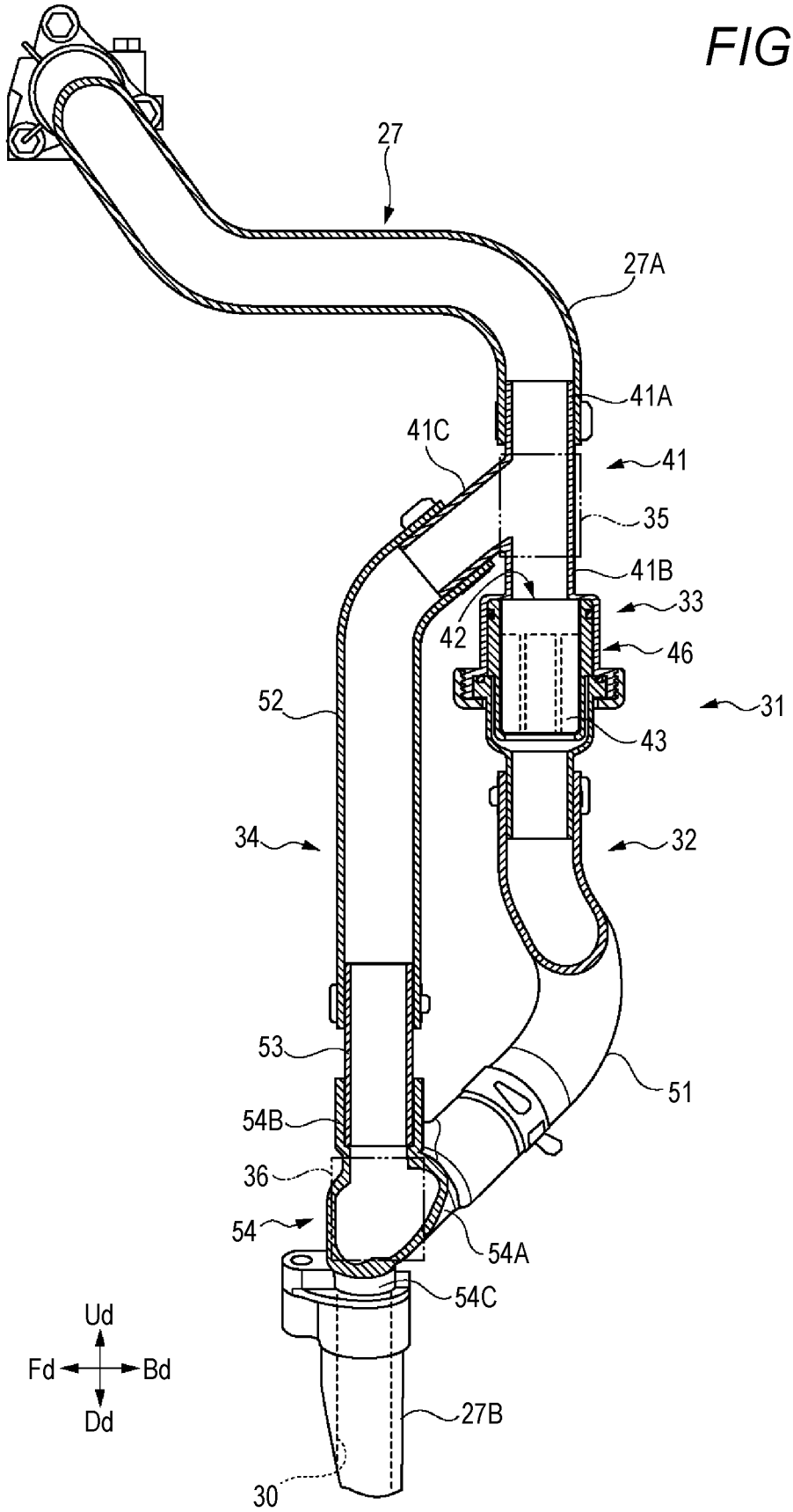
FIG. 6 is a cross-sectional view showing an upstream portion of a drain passage, the fine object collecting device, and a downstream portion of the drain passage cut along a cutting line VI-VI in FIG. 3.
Figure 7:
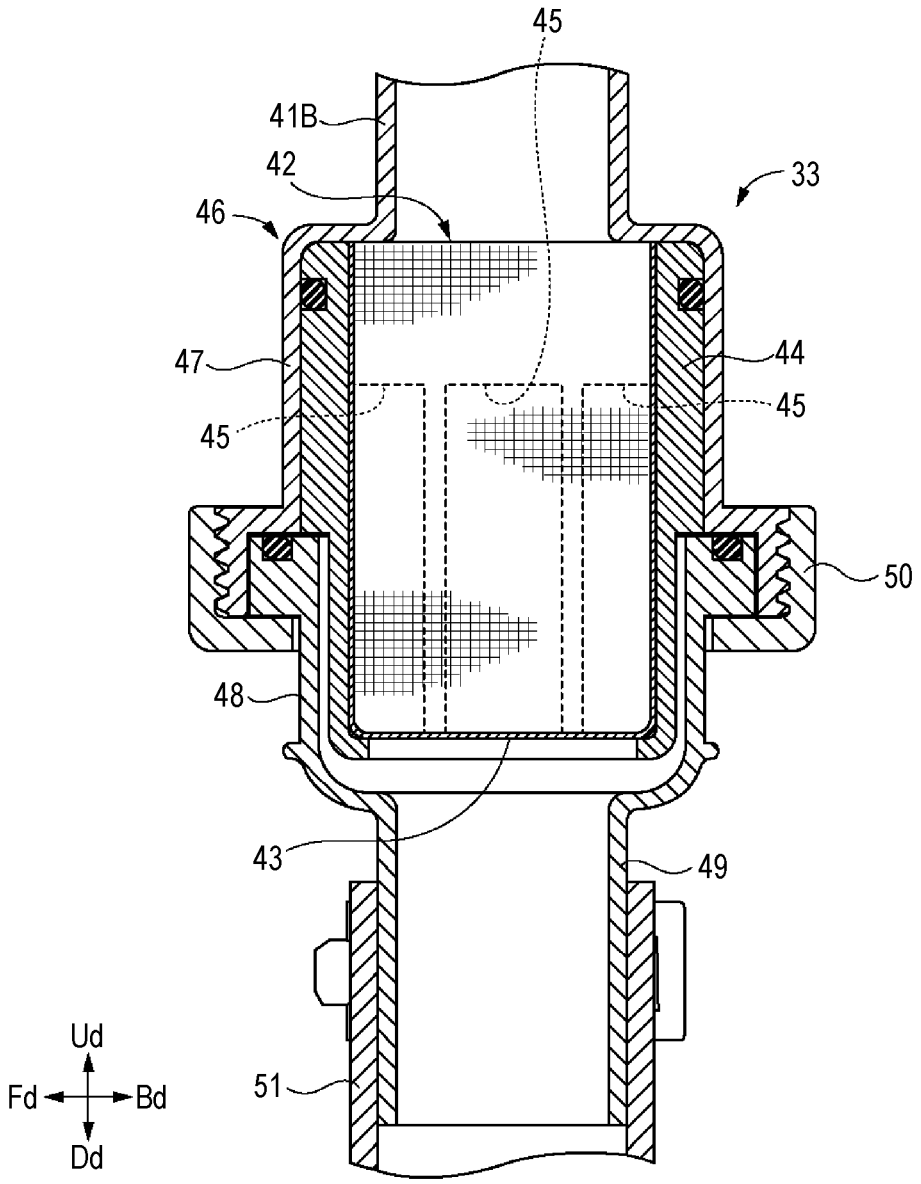
FIG. 7 is an enlarged cross-sectional view showing a case and a filter cartridge in FIG. 6.

FIG. 6 shows details of the configuration of the fine object collecting device 31, and this drawing shows a cross section of the upstream portion 27A of the drain passage 27, the fine object collecting device 31, and the upper end portion of the downstream portion 27B of the drain passage 27 cut along a cutting line VI-VI in FIG. 3, as viewed from the left side. FIG. 7 shows the collector 33 in FIG. 6 in an enlarged manner.

Specifically, as shown in FIG. 6, the fine object collecting device 31 includes the branch pipe 41, the collector 33, a connection hose 51, a bypass pipe 52, a connecting pipe 53, and the confluence pipe 54. A first outflow pipe portion 41B of the branched pipe 41, the connection hose 51, and a first inflow pipe portion 54A of the confluence pipe 54 constitute the collection passage 32. A second outflow pipe portion 41C of the branched pipe 41, the bypass pipe 52, the connecting pipe 53, and a second inflow pipe portion 54B of the confluence pipe 54 constitute the bypass passage 34. In the branched pipe 41, a portion where the inflow pipe portion 41A is branched into the first outflow pipe portion 41B and the second outflow pipe portion 41C corresponds to the branched portion 35. In the confluence pipe 54, a portion where the first inflow pipe portion 54A and the second inflow pipe portion 54B join the outflow pipe portion 54C corresponds to the confluence portion 36.

The branched pipe 41 is a pipe that connects the upstream portion 27A of the drain passage 27 and the collector 33 and connects the upstream portion 27A of the drain passage 27 and the bypass pipe 52. The branched pipe 41 is made of resin having high heat resistance and rigidity, metal having high corrosion resistance, or the like. The branched pipe 41 includes the inflow pipe portion 41A, the first outflow pipe portion 41B, and the second outflow pipe portion 41C. In the branched pipe 41, the inflow pipe portion 41A is positioned on an upper side, and the first outflow pipe portion 41B is positioned on a lower side. The inflow pipe portion 41A and the first outflow pipe portion 41B are arranged coaxially, and a portion of the branched pipe 41 from the inflow pipe portion 41A to the first outflow pipe portion 41B extends vertically and linearly. The inflow pipe portion 41A is arranged coaxially with the lower end portion of the upstream portion 27A of the drain passage 27, and an upper end portion of the inflow pipe portion 41A is connected to the lower end portion of the upstream portion 27A of the drain passage 27. The second outflow pipe portion 41C extends forward while being inclined downward from an approximately middle portion in the up-down direction of a portion of the branched pipe 41 from the inflow pipe portion 41A to the first outflow pipe portion 41B.

The collector 33 includes a filter cartridge 42 and a case 46. As shown in FIG. 7, the filter cartridge 42 includes the filter 43 that collects fine objects and allows the cooling water to pass through, and a holder 44 that holds the filter 43. The filter 43 is made of, for example, non-woven fabric or resin mesh, and is shaped like a bag with an open upper side and a closed lower side. The holder 44 is made of resin having high heat resistance and rigidity, metal having high corrosion resistance, or the like, and is formed in a tubular shape with an axis extending vertically. A plurality of water passage holes 45 are provided on a peripheral wall portion of the holder 44. The filter 43 is arranged inside the holder 44 so as to cover each water passage hole 45 and the lower opening of the holder 44. An upper portion of the filter 43 is attached to an inner peripheral surface of an upper portion of the holder 44 with an adhesive or the like, and is fixed in the holder 44 with the upper portion of the filter 43 open upward.

The case 46 is a member that accommodates the filter cartridge 42. The case 46 is made of resin having high heat resistance and rigidity, metal having high corrosion resistance, or the like, and is formed in a tubular shape with an axis extending vertically. The case 46 is divided into an upper case portion 47 forming an upper portion of the case 46 and a lower case portion 48 forming a lower portion of the case 46. The filter cartridge 42 is held between the upper case portion 47 and the lower case portion 48. The filter cartridge 42 is arranged coaxially with the case 46.

A lower end portion of the first outflow pipe portion 41B of the branched pipe 41 is connected to an upper opening of the upper case portion 47. In the present embodiment, the upper case portion 47 is integrally formed with the first outflow pipe portion 41B of the branched pipe 41. A connection pipe portion 49 is provided below the lower case portion 48, and the lower case portion 48 and the connection pipe portion 49 are integrated with each other.

The lower case portion 48 is separably connected to the upper case portion 47 by a connecting member 50. The connecting member 50 is made into a cylindrical shape and from, for example, resin or metal. The connecting member 50 is held on an outer peripheral side of the lower case portion 48 while being rotatable with respect to the lower case portion 48 and movable in the up-down direction with respect to the lower case portion 48. Screws are formed on an outer peripheral surface of the lower end portion of the upper case portion 47 and an inner peripheral surface of the connecting member 50, respectively, and the lower case portion 48 is connected to the upper case portion 47 by screwing the connecting member 50 rotatably held to the lower case portion 48 to the lower end portion of the upper case portion 47. The lower case portion 48 is separated from the upper case portion 47 by rotating the connecting member 50 in a direction in which the screws are loosened and removing the connecting member 50 from the lower end portion of the upper case portion 47.

The connection hose 51 is a pipe that connects the case 46 and the first inflow pipe portion 54A of the confluence pipe 54. The connection hose 51 is made of a rubber hose having high heat resistance and rigidity. The connection hose 51 has high rigidity and also flexibility. As shown in FIG. 6, the upper end portion of the connection hose 51 is arranged coaxially with the case 46, and is connected to a lower end portion of the connection pipe portion 49 integrally formed with the lower case portion 48. The connection hose 51 extends vertically and downward from an upper end portion thereof and then bends gently, then extends downward while being inclined to a rear right side and then bends gently, and then extends downward while being inclined to a front left side. In this way, since a part of the connection hose 51 is inclined with respect to the vertical direction, the connecting member 50 is rotated in the direction in which the screws are loosened so that the lower case portion 48 can be separated from the upper case portion 47, and by gripping the upper end portion of the connection hose 51 by hand and pushing down the upper end portion of the connection hose 51, the lower case portion 48 can be separated from the upper case portion 47. The filter cartridge 42 can be removed from the case 46 by pulling the lower case portion 48 away from the upper case portion 47. A user can remove the filter cartridge 42 from the case 46 in this manner to remove fine objects accumulated in the filter 43.

The bypass pipe 52 is made of a rubber hose having high heat resistance and rigidity, a resin pipe having high heat resistance and rigidity, or a metal pipe having high corrosion resistance. An upper end portion of the bypass pipe 52 is connected to the lower end portion of the second outflow pipe portion 41C of the branched pipe 41. The bypass pipe 52 extends downward from an upper end thereof while being inclined forward with respect to the vertical direction, then bends, and then extends vertically downward.

The connecting pipe 53 is made of resin having high heat resistance and rigidity, metal having high corrosion resistance, or the like. The connecting pipe 53 extends vertically and is arranged coaxially with the bypass pipe 52, and the upper end portion of the connecting pipe 53 is connected to the lower end portion of the bypass pipe 52.

The confluence pipe 54 is a pipe that connects the connection hose 51 and the downstream portion 27B of the drain passage 27 and also connects the bypass pipe 52 to the downstream portion 27B of the drain passage 27 via the connecting pipe 53. The confluence pipe 54 is made of resin having high heat resistance and rigidity, metal having high corrosion resistance, or the like. The confluence pipe 54 includes the first inflow pipe portion 54A, the second inflow pipe portion 54B, and the outflow pipe portion 54C. In the confluence pipe 54, the second inflow pipe portion 54B is positioned on an upper side, and the outflow pipe portion 54C is positioned on a lower side. The second inflow pipe portion 54B and the outflow pipe portion 54C are arranged coaxially, and a portion of the confluence pipe 54 from the second inflow pipe portion 54B to the outflow pipe portion 54C extends linearly and vertically. The second inflow pipe portion 54B and the connecting pipe 53 are arranged coaxially with each other, and a lower end portion of the connecting pipe 53 is connected to an upper end portion of the second inflow pipe portion 54B. A lower end portion of the outflow pipe portion 54C is arranged substantially coaxially with the drain hole 30 forming the upper end portion of the downstream portion 27B of the drain passage 27, and the lower end portion of the outflow pipe portion 54C is connected to the upper end portion of the drain hole 30. The first inflow pipe portion 54A extends rearward while being inclined to an upper right side from a substantially middle portion in the up-down direction of a portion of the confluence pipe 54 from the second inflow pipe portion 54B to the outflow pipe portion 54C. The lower end portion of the connection hose 51 is connected to the upper end portion of the first inflow pipe portion 54A.

Inner diameters of the inflow pipe portion 41A of the branched pipe 41, the first outflow pipe portion 41B of the branched pipe 41, the second outflow pipe portion 41C of the branch pipe 41, the connection hose 51, the bypass pipe 52, the connecting pipe 53, the first inflow pipe portion 54A of the confluence pipe 54, the second inflow pipe portion 54B of the confluence pipe 54, and the outflow pipe portion 54C of the confluence pipe 54 have substantially equal to each other.

As described above, in the cooling device 21 of the outboard motor 1 according to the embodiment of the present disclosure, the upstream portion 27A of the drain passage 27, the collection passage 32, and the bypass passage 34 are arranged such that a difference between a flowing direction of the cooling water flowing from the upstream portion 27A of the drain passage 27 into the branched portion 35 and a flowing direction of the cooling water flowing from the branched portion 35 into the collection passage 32 is smaller than a difference between the flowing direction of the cooling water flowing from the upstream portion 27A of the drain passage 27 into the branched portion 35 and a flowing direction of the cooling water flowing from the branched portion 35 into the bypass passage 34.

By arranging the upstream portion 27A of the drain passage 27, the collection passage 32, and the bypass passage 34 in this way, when the filter 43 of the collector 33 is not clogged, the cooling water flowing out from the upstream portion 27A of the drain passage 27 is more likely to flow into the collection passage 32 than the bypass passage 34. In this way, when the filter 43 of the collector 33 is not clogged, most of the cooling water flowing out from the upstream portion 27A of the drain passage 27 can smoothly flow into the collection passage 32 and be sent to the collector 33 without using a valve or the like that opens or closes the bypass passage 34 depending on whether the filter 43 of the collector 33 is clogged or not. That is, even when the upstream portion 27A of the drain passage 27 and an inlet of the bypass passage 34 are always in communication with each other, the cooling water flowing out from the upstream portion 27A of the drain passage 27 can be prevented from flowing into the bypass passage 34 when the filter 43 of the collector 33 is not clogged. Therefore, when the filter 43 of the collector 33 is not clogged, it is possible to prevent a decrease in an amount of the cooling water flowing through the collector 33 by the cooling water flowing into the bypass passage 34, and to prevent a decrease in ability of the cooling device 21 for collecting the fine objects.

In the cooling device 21 according to the present embodiment, the upstream portion 27A of the drain passage 27 and the collection passage 32 are arranged such that the flowing direction of the cooling water flowing from the upstream portion 27A of the drain passage 27 into the branched portion 35 is the same as the flowing direction of the cooling water flowing from the branched portion 35 into the collection passage 32, and the upstream portion 27A of the drain passage 27 and the bypass passage 34 are arranged such that the flowing direction of the cooling water flowing from the upstream portion 27A of the drain passage 27 into the branched portion 35 is different from the flowing direction of the cooling water flowing from the branched portion 35 into the bypass passage 34. With this configuration, when the filter 43 of the collector 33 is not clogged, most of the cooling water flowing out from the upstream portion 27A of the drain passage 27 can further smoothly flow into the collection passage 32, and the ability of the cooling device 21 for collecting the fine objects can be sufficiently ensured.

In the cooling device 21 according to the present embodiment, the upstream portion 27A of the drain passage 27 is arranged such that the flowing direction of the cooling water flowing from the upstream portion 27A of the drain passage 27 into the branched portion 35 is downward and vertical, the collection passage 32 is arranged such that the flowing direction of the cooling water flowing from the branched portion 35 into the collection passage 32 is downward and vertical, and the bypass passage 34 is arranged such that the flowing direction of the cooling water flowing from the branched portion 35 into the bypass passage 34 is not vertical. With this configuration, when the filter 43 of the collector 33 is not clogged, most of the cooling water flowing out from the upstream portion 27A of the drain passage 27 can further smoothly flow into the collection passage 32.

The collection passage 32 and the bypass passage 34 intersect each other at an acute angle at the branched portion 35. Therefore, when the filter 43 of the collector 33 is clogged, the cooling water flowing out from the upstream portion 27A of the drain passage 27 can smoothly flow into the bypass passage 34. Therefore, it is possible to prevent deterioration of the flow of the cooling water in the drain passage 27 due to clogging of the filter 43 of the collector 33.

In the cooling device 21 according to the present embodiment, the collection passage 32, the bypass passage 34, and the downstream portion 27B of the drain passage 27 are arranged such that a difference between a flowing direction of the cooling water flowing from the bypass passage 34 into the confluence portion 36 and a flowing direction of the cooling water flowing from the confluence portion 36 into the downstream portion 27B of the drain passage 27 is smaller than a difference between a flowing direction of the cooling water flowing from the collection passage 32 into the confluence portion 36 and a flowing direction of the cooling water flowing from the confluence portion 36 into the downstream portion 27B of the drain passage 27. By arranging the downstream portion 27B of the drain passage 27, the collection passage 32, and the bypass passage 34 in this way, the flowing direction of the cooling water from the bypass passage 34 into the downstream portion 27B of the drain passage 27 can be made linear or nearly linear. Therefore, when the filter 43 of the collector 33 is clogged, the cooling water can flow smoothly from the bypass passage 34 to the downstream portion 27B of the drain passage 27, and the cooling water flowing through the bypass passage 34 can be prevented from flowing from the outlet of the collection passage 32 into the collection passage 32 and flowing back through the collection passage 32. By arranging the downstream portion 27B of the drain passage 27, the collection passage 32, and the bypass passage 34 as described above, when the exhaust gas flows backward through the downstream portion 27B of the drain passage 27 from the exhaust chamber 17 of the outboard motor 1, the flowing direction of the exhaust gas from the downstream portion 27B of the drain passage 27 into the bypass passage 34 can be made linear or nearly linear, and the flowing direction of the exhaust gas from the downstream portion 27B of the drain passage 27 into the collection passage 32 can be bent. Therefore, the exhaust gas flowing backward through the downstream portion 27B of the drain passage 27 from the exhaust chamber 17 can smoothly flow to the bypass passage 34, and the exhaust gas flowing backward through the downstream portion 27B of the drain passage 27 is prevented from flowing from the outlet of the collection passage 32 into the collection passage 32 and flowing back through the collection passage 32. In this way, since the backflow of the cooling water or the exhaust gas into the collection passage 32 can be prevented, the fine objects accumulated in the filter 43 can be prevented from being lifted up by the cooling water or the exhaust gas passing through the collector 33 from bottom to top. Therefore, even when the inlet of the collection passage 32 and the inlet of the bypass passage 34 are always in communication with each other at the branched portion 35, the fine objects temporarily accumulated in the filter 43 can be prevented from being lifted up and discharged to the outside of the outboard motor 1 through the bypass passage 34 and the downstream portion 27B of the drain passage 27. In this way, according to the present embodiment, even if a valve or the like that opens or closes the bypass passage 34 depending on whether the filter 43 of the collector 33 is clogged or not is not provided, the fine objects temporarily accumulated in the filter 43 can be prevented from being discharged to the outside of the outboard motor 1 by the backflow of the cooling water or the exhaust gas, and therefore, it is possible to sufficiently ensure the ability of the cooling device 21 for collecting the fine objects.

In the cooling device 21 according to the present embodiment, the bypass passage 34 and the downstream portion 27B of the drain passage 27 are arranged such that the flowing direction of the cooling water flowing from the bypass passage 34 into the confluence portion 36 is substantially the same as the flowing direction of the cooling water flowing from the confluence portion 36 into the downstream portion 27B of the drain passage 27, and the collection passage 32 and the downstream portion 27B of the drain passage 27 are arranged such that the flowing direction of the cooling water flowing from the collection passage 32 into the confluence portion 36 is different from the flowing direction of the cooling water flowing from the confluence portion 36 into the downstream portion 27B of the drain passage 27. With this configuration, when the filter 43 of the collector 33 is clogged, smoothness of the flow of the cooling water flowing from the bypass passage 34 to the downstream portion 27B of the drain passage 27 can be enhanced, and smoothness of the flow of the exhaust gas flowing backward from the downstream portion 27B of the drain passage 27 to the bypass passage 34 can be enhanced. Therefore, the effect of preventing the backflow of the cooling water or the exhaust gas to the collection passage 32 can be enhanced, and the effect of preventing the lifting of the fine objects accumulated in the filter 43 can be enhanced.

In the cooling device 21 according to the present embodiment, the bypass passage 34 is arranged such that the flowing direction of the cooling water flowing from the bypass passage 34 into the confluence portion 36 is downward and vertical, the downstream portion 27B of the drain passage 27 is arranged such that the flowing direction of the cooling water flowing from the confluence portion 36 into the downstream portion 27B of the drain passage 27 is downward and substantially vertical, and the collection passage 32 is arranged such that the flowing direction of the cooling water flowing from the collection passage 32 into the confluence portion 36 is not vertical. With this configuration, when the filter 43 of the collector 33 is clogged, smoothness of the flow of the cooling water flowing from the bypass passage 34 to the downstream portion 27B of the drain passage 27 can be further enhanced. Therefore, the effect of preventing the backflow of the cooling water to the collection passage 32 can be further enhanced.

The collection passage 32 and the bypass passage 34 intersect each other at an acute angle at the confluence portion 36. Therefore, when the filter 43 of the collector 33 is not clogged, the cooling water flowing out from the collector 33 can smoothly flow to the downstream portion 27B of the drain passage 27 through the collection passage 32. When the filter 43 of the collector 33 is clogged, it is possible to prevent the cooling water flowing through the bypass passage 34 from flowing from the outlet of the collection passage 32 into the collection passage 32.

Note that in the above embodiment, the upstream portion 27A of the drain passage 27 and the collection passage 32 are arranged such that the flowing direction of the cooling water flowing from the upstream portion 27A of the drain passage 27 into the branched portion 35 is the same as the flowing direction of the cooling water flowing from the branched portion 35 into the collection passage 32. The flowing direction of the cooling water flowing from the upstream portion 27A of the drain passage 27 into the branched portion 35 and the flowing direction of the cooling water flowing from the branched portion 35 into the collection passage 32 may not be completely the same, and may be slightly different as long as the smoothness of the flow of the cooling water from the upstream portion 27A of the drain passage 27 to the collection passage 32 can be ensured when the filter 43 of the collector 33 is not clogged.

Note that in the above embodiment, the bypass passage 34 and the downstream portion 27B of the drain passage 27 are arranged such that the flowing direction of the cooling water flowing from the bypass passage 34 into the confluence portion 36 is substantially the same as the flowing direction of the cooling water flowing from the confluence portion 36 into the downstream portion 27B of the drain passage 27. The flowing direction of the cooling water flowing from the bypass passage 34 into the confluence portion 36 and the flowing direction of the cooling water flowing from the confluence portion 36 into the downstream portion 27B of the drain passage 27 are not completely the same but slightly different from each other since the extending direction of the upper end portion (drain hole 30) of the downstream portion 27B of the drain passage 27 is slightly inclined with respect to the vertical direction. However, if the difference is to this extent, the smoothness of the flow of the cooling water from the bypass passage 34 to the downstream portion 27B of the drain passage 27 and the smoothness of the flow of the exhaust gas from the downstream portion 27B of the drain passage 27 to the bypass passage 34 can be ensured, and therefore, this degree of difference can be regarded as the same. Moreover, the extending direction of the upper end portion (drain hole 30) of the downstream portion 27B of the drain passage 27 may be vertical, and the flowing direction of the cooling water flowing from the bypass passage 34 to the confluence portion 36 and the flowing direction of the cooling water flowing from the confluence portion 36 into the downstream portion 27B of the drain passage 27 may be completely the same.

In the above embodiment, the upstream portion 27A of the drain passage 27 is arranged such that the flowing direction of the cooling water flowing from the upstream portion 27A of the drain passage 27 into the branched portion 35 is downward and vertical. Specifically, the lower end portion of the upstream portion 27A of the drain passage 27 extends vertically. The collection passage 32 is arranged such that the flowing direction of the cooling water flowing from the branched portion 35 into the collection passage 32 is downward and vertical. Specifically, the upper end portion of the collection passage 32 extends vertically. The bypass passage 34 is arranged such that the flowing direction of the cooling water flowing from the bypass passage 34 into the confluence portion 36 is downward and vertical. Specifically, the lower end portion of the bypass passage 34 extends vertically. These flowing directions and extending directions may not be perfectly vertical, and may be slightly inclined with respect to the vertical direction.

In the above embodiment, the fine object collecting device 31 is arranged on the left side of the rear portion of the engine 2, but the fine object collecting device 31 may be arranged at other positions around the engine 2, such as the right side of the rear portion of the engine 2.

The power source of the outboard motor 1 is not limited to the engine, and may be an electric motor. The cooling device of the present disclosure is not limited to the outboard motor, and can also be provided for ship propulsion machine of other types such as an inboard-outboard motor or an inboard motor.

The present disclosure can be modified as appropriate without departing from the scope or spirit of the disclosure which can be read from the claims and the entire specification, and the cooling device of a ship propulsion machine to which such a change is applied is also included in the technical concept of the present disclosure.

What is claimed is:

1. A cooling device for a ship propulsion machine, the cooling device being provided in a ship propulsion machine, taking water of an outside of the ship propulsion machine into the ship propulsion machine, cooling a power source of the ship propulsion machine by flowing the taken water around or inside the power source as cooling water, and discharging the cooling water after flowing around or inside the power source to the outside of the ship propulsion machine, the cooling device comprising:

a drain passage configured to discharge the cooling water after flowing around or inside the power source to the outside of the ship propulsion machine;

a collection passage provided between an upstream portion and a downstream portion of the drain passage and connecting the upstream portion and the downstream portion of the drain passage;

a collector provided in a middle of the collection passage and configured to collect fine objects contained in the cooling water flowing through the collection passage from the upstream portion of the drain passage toward the downstream portion of the drain passage;

a bypass passage provided in parallel with the collection passage between the upstream portion and the downstream portion of the drain passage and connecting the upstream portion and the downstream portion of the drain passage;

a branched portion where the upstream portion of the drain passage branches into the collection passage and the bypass passage; and a confluence portion where the collection passage and the bypass passage join the downstream portion of the drain passage, wherein the upstream portion of the drain passage, the collection passage, and the bypass passage are arranged such that a difference between a flowing direction of the cooling water flowing from the upstream portion of the drain passage into the branched portion and a flowing direction of the cooling water flowing from the branched portion into the collection passage is smaller than a difference between the flowing direction of the cooling water flowing from the upstream portion of the drain passage into the branched portion and a flowing direction of the cooling water flowing from the branched portion into the bypass passage, and the downstream portion of the drain passage, the collection passage, and the bypass passage are arranged such that a difference between a flowing direction of the cooling water flowing from the bypass passage into the confluence portion and a flowing direction of the cooling water flowing from the confluence portion into the downstream portion of the drain passage is smaller than a difference between a flowing direction of the cooling water flowing from the collection passage into the confluence portion and a flowing direction of the cooling water flowing from the confluence portion into the downstream portion of the drain passage.

2. The cooling device for a ship propulsion machine according to claim 1, wherein the upstream portion of the drain passage and the collection passage are arranged such that the flowing direction of the cooling water flowing from the upstream portion of the drain passage into the branched portion is the same as the flowing direction of the cooling water flowing from the branched portion into the collection passage, and the upstream portion of the drain passage and the bypass passage are arranged such that the flowing direction of the cooling water flowing from the upstream portion of the drain passage into the branched portion is different from the flowing direction of the cooling water flowing from the branched portion into the bypass passage.

3. The cooling device for a ship propulsion machine according to claim 1, wherein the collection passage and the downstream portion of the drain passage are arranged such that the flowing direction of the cooling water flowing from the collection passage into the confluence portion is different from the flowing direction of the cooling water flowing from the confluence portion into the downstream portion of the drain passage, and the bypass passage and the downstream portion of the drain passage are arranged such that the flowing direction of the cooling water flowing from the bypass passage into the confluence portion is the same as the flowing direction of the cooling water flowing from the confluence portion into the downstream portion of the drain passage.

4. The cooling device for a ship propulsion machine according to claim 1, wherein the upstream portion of the drain passage is arranged such that the flowing direction of the cooling water flowing from the upstream portion of the drain passage into the branched portion is downward and vertical, the collection passage is arranged such that the flowing direction of the cooling water flowing from the branched portion into the collection passage is downward and vertical, and the bypass passage is arranged such that the flowing direction of the cooling water flowing from the branched portion into the bypass passage is not vertical.

5. The cooling device for a ship propulsion machine according to claim 1, wherein the collection passage is arranged such that the flowing direction of the cooling water flowing from the collection passage into the confluence portion is not vertical, the bypass passage is arranged such that the flowing direction of the cooling water flowing from the bypass passage into the confluence portion is downward and vertical, and the downstream portion of the drain passage is arranged such that the flowing direction of the cooling water flowing from the confluence portion into the downstream portion of the drain passage is downward and vertical.

6. The cooling device for a ship propulsion machine according to claim 1, wherein the collection passage and the bypass passage intersect each other at an acute angle at the branched portion.

7. The cooling device for a ship propulsion machine according to claim 1, wherein the collection passage and the bypass passage intersect each other at an acute angle at the confluence portion.

* * * * *